3/5/85 XR 4,503,357

United States Patent [19]

Ouhata et al.

[11] Patent Number: 4,503,357

[45] Date of Patent: Mar. 5, 1985

[54] CATHODE-RAY TUBE

[75] Inventors: Koukichi Ouhata; Hiroyuki Sugawara, both of Hitachi, Japan

[73] Assignee: Hitachi, Ltd., Tokyo, Japan

[21] Appl. No.: 452,447

[22] Filed: Dec. 23, 1982

[30] Foreign Application Priority Data

Feb. 24, 1982 [JP] Japan ..... 57-27358

[51] Int. Cl.[3] ..... H01J 23/34

[52] U.S. Cl. ..... 315/1; 313/299; 313/402; 313/414; 313/479; 313/313; 315/8

[58] Field of Search ..... 315/1.0, 8.0; 313/299, 313/402, 414, 479, 313, 457

[56] References Cited

U.S. PATENT DOCUMENTS

| | | | |
|---|---|---|---|
| 2,659,022 | 11/1953 | Oestreicher | 315/1 |
| 3,443,138 | 5/1969 | Schwartz | 315/8 |
| 3,558,954 | 1/1971 | Lelleuy | 313/313 |
| 4,288,719 | 9/1981 | Hernquist | 313/457 |
| 4,353,006 | 10/1982 | Schade | 313/457 |
| 4,392,083 | 7/1983 | Costello | 315/8 |
| 4,439,710 | 3/1984 | Osakabe et al. | 313/414 |

*Primary Examiner*—Harold Dixon

*Attorney, Agent, or Firm*—Antonelli, Terry & Wands

[57] ABSTRACT

A cathode-ray tube has in a neck section of a hermetically sealed, evacuated envelope an electron-gun mount assembly in which of a cathode for emitting an electron beam, a first grid electrode section for forming a cross-over point and for accelerating the electron beam and a second grid electrode section for focusing the electron beam are mounted on a plurality of insulative supporting bars. A conductive member is provided on an outer surface portion of the neck section, an inner surface portion thereof, and/or an outer surface portion of the supporting bars which surround a portion of the electron-gun mount assembly including the first grid electrode section but excepting the second grid electrode section.

7 Claims, 9 Drawing Figures

CATHODE-RAY TUBE

The present invention relates to a cathode-ray tube and more particularly to a cathode-ray tube having a means for preventing the occurrence of abnormal illumination, abnormal blue glow, or discharge in the tube or its neck section caused by undesired emission of electrons from an electron-gun mount assembly within an evacuated envelope during the normal operation of the cathode-ray tube.

As shown in FIG. 1, a known cathode-ray tube is usually composed of a hermetically sealed, evacuated envelope made of glass including a neck section 11, a funnel section 12 and a panel section 13. In the tube are provided an electron-gun mount assembly 21, a shadow mask 22, a luminescent viewing screen 23, an inner conductive coating 24 and a contact finger 25. Electrical connections between the outside and the inside of the above described envelope include an anode button 31 and stem pins 32.

As illustrated in FIG. 2, the electron-gun mount assembly 21 includes a plurality of spaced electrodes concentrically mounted on at least two electrically insulative supporting bars 26 normally made of bead glass. The illustration shows as an example the bi-potential focus type gun arrangement which includes a cathode K, low potential electrodes 27 having a first grid electrode ($G_1$) 27*a* and a second grid electrode ($G_2$) 27*b*, a third grid electrode ($G_3$) or focusing electrode 28, and a fourth grid electrode ($G_4$), an anode or high potential electrode 29. The electron-gun mount assembly 21 is incorporated into the neck section 11 serves to generate one electron beam or more electron beams (in the case of multi-gun assembly) for radiating the inner surface of the panel 13. In FIG. 2, H denotes a heater.

In conventional cathode-ray tubes, it was known that a dark current may be produced by undesired emission of electrons from a part of the electron gun due to various, thereby resulting in abnormal illumination, abnormal blue glow, or charging of the neck or bead glass and/or discharge in the tube.

Japanese Patent Application Laid-Open No. 122345/80 has disclosed that it is effective in preventing discharge within the tube to coat, a portion of the outer surface of the bead glass 26 near the focusing electrode 28 and facing the neck section 11, with a conductive film 30 which is preferably electrically floating, as shown in FIGS. 3*a* and 3*b*. FIG. 3*b* is a sectional view of the neck section 11 seen from a direction of IIIb—IIIb of FIG. 3*a*.

Further, as shown in FIG. 4, Japanese Patent Application Laid-Open No. 9938/81 discloses another discharge prevention approach wherein a conductive member 40 is placed to cover entirely the outer surface surrounding the electron gun of the neck section 11 at an aging step of a manufacturing process for the cathode-ray tube. The conductive member 40 is later removed. That is to say, the conductive member 40 is not contained in the cathode-ray tube when the tube is used. The electron gun shown in FIG. 4 is of uni-potential focus type. Numeral 28' denotes a focusing electrode, and 29' and 29'' high potential electrodes to which an anode potential is applied. As described in the Japanese Patent Application Laid-Open No. 9938/81, the usual aging step is carried out in such a manner that by applying the earth potential at the cathode terminal of a high voltage source 41 to the cathode K, low potential electrodes 27*a* and 27*b*, and the focusing electrode 28' and at the same time applying a high potential twice to three times that of the normal operating voltage to the high potential electrodes 29'' and 29' through a resistor 42, an anode button 31, an inner conductive coating 24, and a contact finger 25, high voltage discharge is caused between the electrodes 29'' and 28', between the electrodes 28' and 29', and between the electrodes 29' and 27*b* to remove foreign substances on or fines of each electrode. When the thus processed cathode-ray tube is actually used, however, a deflection yoke and a puriting magnet mounted around the neck section 11 near the anode 29'' cause the potential of the neck section 11 to approach the earth potential or a high voltage is developed between the inner wall of the neck section 11 and the electrodes 29'' and 29' to which a high operating potential is applied. As a result, foreign substances remaining on these electrodes may move due to the intense electric field so that discharge occurs within the tube or a dark current is increased. Therefore, the Japanese Patent Application Laid-Open No. 9938/81 has proposed an aging step in which the conductive member 40 is placed to cover entirely the outer surface of the neck section 11 surrounding the electron gun, as shown in FIG. 4, and the conductive member 40 is connected to the earth potential to forcibly cause high voltage discharge between the electrodes 29'' and 29' and the inner wall of the neck section 11. The conductive member 40 is removed after this proposed aging step and the completed cathode-ray tube is put to practical use.

An object of the present invention is to provide a novel cathode-ray tube in which abnormal illumination, abnormal blue glow, charging and/or discharge (spark) in the neck section is obviated in practical use by decreasing the dark current in the electron gun.

According to the present invention, there is provided a cathode-ray tube comprising: a hermetically sealed, evacuated envelope having an electrically insulative neck section; an electron-gun mount assembly incorporated into said neck section and including a cathode electrode means for emitting an electron beam, first grid electrode means for forming a crossover point and for accelerating the electron beam, and second grid electrode means for focusing the electron beam, said cathode electrode means, said first grid electrode means and said second grid electrode means being arranged in this order along the tube axis and being mounted on a supporting means having a plurality of electrically insulative supporting bars disposed around said electron-gun mount assembly; a conductive member which at least partially covers in a contacting fashion at least one of an outer surface portion of said neck section, an inner surface portion of said neck section and an outer surface portion of said supporting means which surround a portion of said electron-gun mount assembly including said first grid electrode means but excepting said second grid electrode means; and a means for applying a predetermined potential to said conductive member during a normal operation of the tube.

The above and other objects and features of the present invention will become apparent from the following detailed description made in conjunction with the accompanying drawings, in which.

Figure 1:
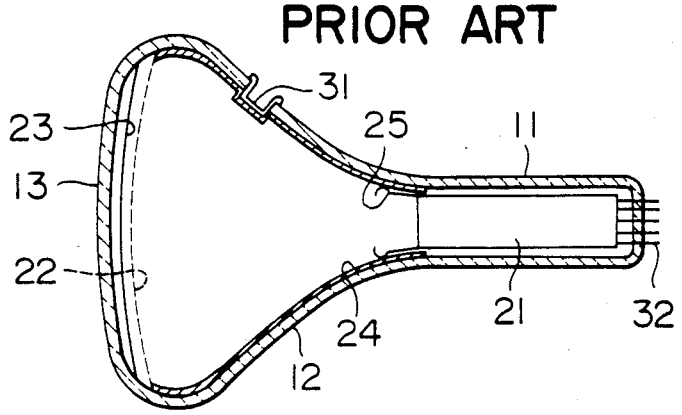
FIG. 1 PRIOR ART
FIG. 1 is a schematic sectional view of a conventional typical cathode-ray tube.
Figure 2:
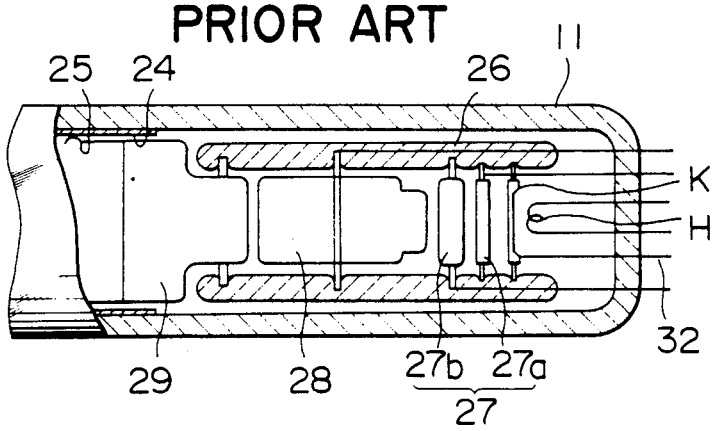
FIG. 2 PRIOR ART
FIG. 2 is a sectional view of a neck section shown in FIG. 1.
Figure 3A:
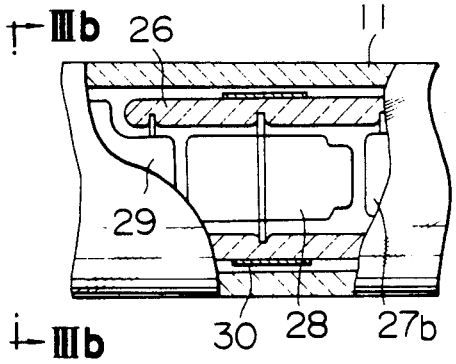
FIG. 3a PRIOR ART
Figure 3B:
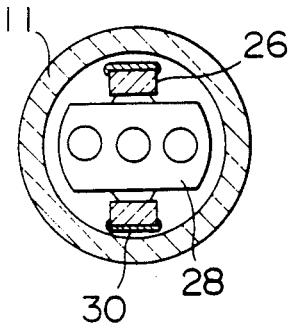
FIG. 3b PRIOR ART

FIG. 3*a* is a broken-out sectional view of a neck section in a conventional cathode-ray tube having a discharge preventing means in the neck section;

FIG. 3*b* is a sectional view of the neck section seen from a direction of IIIb—IIIb of FIG. 3*a;*

Figure 4:
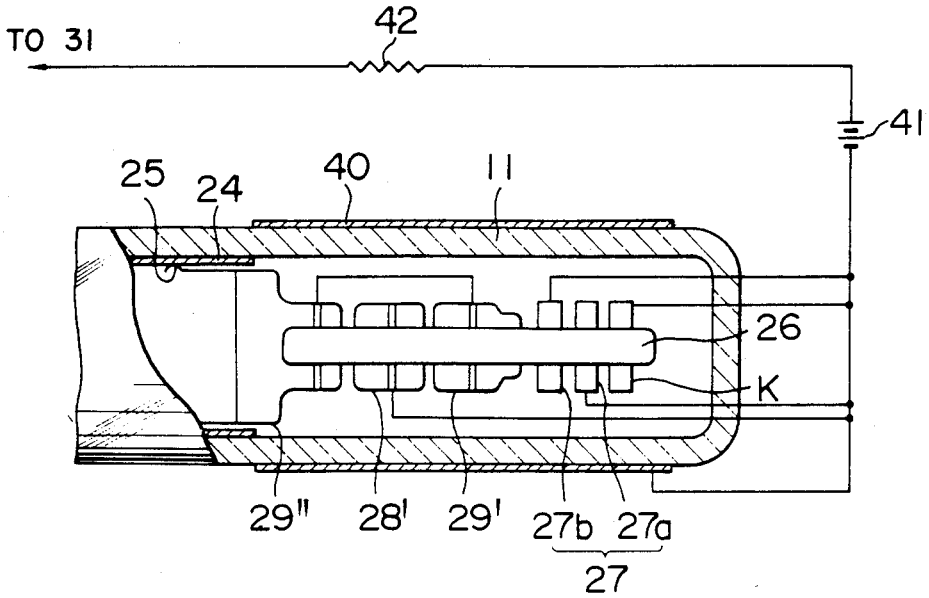
FIG. 4 PRIOR ART
Figure 5:
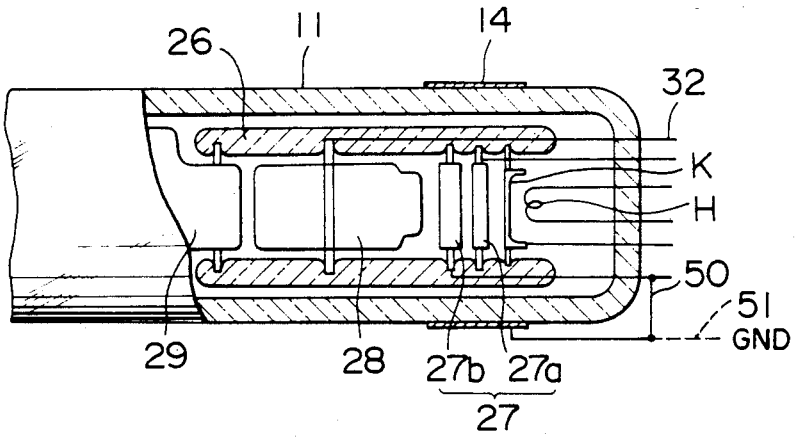
Figure 6:
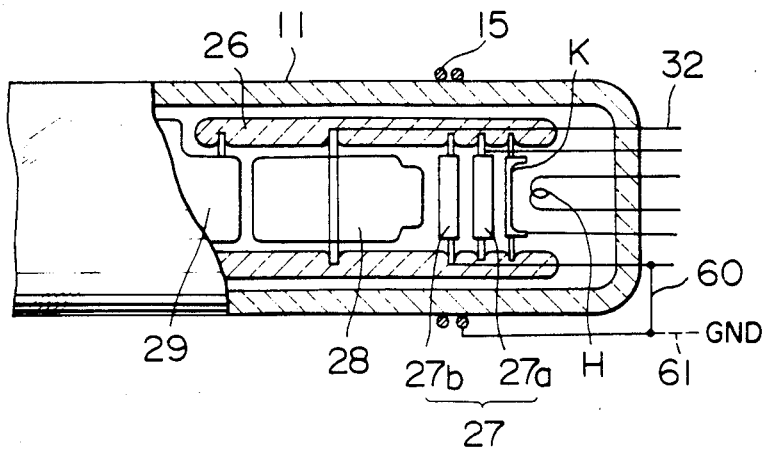
Figure 7:
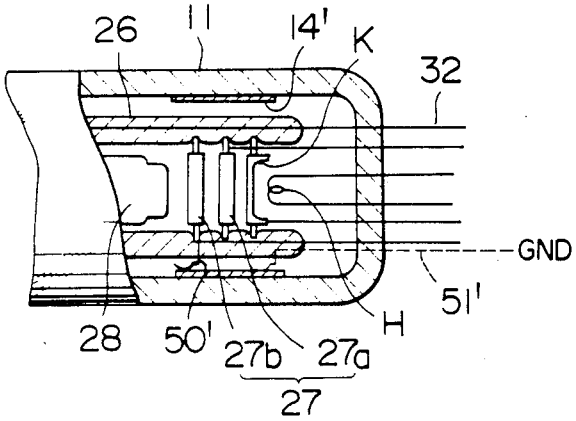
Figure 8:
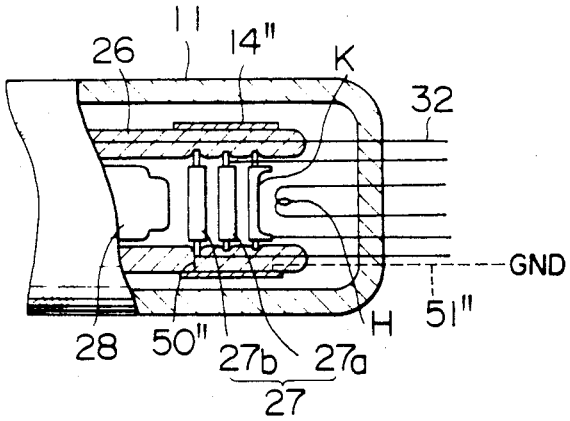

FIG. 4 is a schematic diagram illustrating a neck section of another conventional cathode-ray tube having a discharge preventing means in the neck section;

FIG. 5 is a sectional view of the neck section of a cathode-ray tube according to an embodiment of the present invention;

FIG. 6 is a sectional view of the neck section of a cathode-ray tube according to another embodiment of the present invention;

FIG. 7 is a sectional view of the neck section of a cathode-ray tube according to still another embodiment of the present invention; and FIG. 8 is a sectional view of the neck section of a cathode-ray tube according to a further embodiment of the present invention.

The present inventors found that a dark current in the normal use of a cathode-ray tube is mainly caused by an electric field concentrated to fine projections or foreign substances which are present on the surface or edges of electrodes of the electron gun, especially the low potential electrode. The reason is regarded as follows. Bead glass of the supporting bars or glass of the neck section being dielectric has certain potentials distributed thereover when the operating potentials are applied to respective electrodes during the normal use of the tube. On the other hand, there is established a large potential difference between the low potential electrode and the focusing electrode or the high potential electrode. Therefore, especially if fine projections or foreign substances exist on the surface or edges of the low potential electrode, the concentration of an electric field to them takes places forming an electron path of projections or foreign substances→neck section or bead glass→focusing electrode or high potential electrode, with a result that a dark current originating from undesired electron emission flows and the increased dark current induces abnormal illumination, abnormal blue glow, or charging of the glass of the neck section and/or discharge in the tube.

FIG. 5 shows the neck section of a cathode-ray tube according to an embodiment of the present invention. An electrically insulative neck section 11 of a hermetically sealed, evacuated envelope contains therein an electron-gun mount assembly. The electron-gun mount assembly includes along the tube an electrode K for emitting an electron beam, a first grid electrode ($G_1$) 27*a* for forming a crossover point, the electrode 27*a* being normally applied with a negative potential or a potential of 100 V or less, a second grid electrode ($G_2$) 27*b* for accelerating the emitted electron beam, the electrode 27*b* being normally applied with a potential of several hundred volts such as 500 to 600 V, a third grid electrode ($G_3$) 28 normally applied with a potential of several kilovolts such as 6 to 7 KV, and a fourth grid electrode ($G_4$) 29 normally applied with several tens of kilovolts such as 25 to 33 KV. These electrodes are mounted on at least two electrically insulative supporting bars 26 such as bead glass. The first grid electrode 27*a* and the second grid electrode 27*b* may be called low potential electrodes 27. The third grid electrode 28 and the fourth grid electrode 29 serve to focus the electron beam and may be called a focusing electrode and an anode, respectively. In this embodiment, a conductive film 14 or a thin, cylindrical metal plate such as Cu or Al foil which is 5 to 10 mm in width and 50 to 80 μm in thickness is wound around and in close contact with the outer surface portion of the neck section 11 surrounding the first and second grid electrodes 27*a* and 27*b*. It is possible to mitigate the concentration of an electric field from the high potential electrode 29 or the focusing electrode 28 toward fine projections or foreign substances on the low potential electrodes 27*a* and 27*b* by connecting the conductive film 14 to the same potential as the second grid electrode 27*b* of the low potential electrodes 27 via a lead 50 or to the earth potential via a lead 51. As a result, the above-mentioned undesired electron emission from the low potential electrodes 27*a* and 27*b* is significantly decreased to substantially abnormal illumination, abnormal blue glow, charging and/or spark.

The above-described effect cannot be expected in the construction of FIG. 3*a* wherein the outer surface of the bead glass 26 near the focusing electrode 28 is coated with the conductive film 30. Prior to putting the cathode-ray tube to practical use, the high potential electrode 29 and the focusing electrode 28 are applied with high potentials twice to three times as high as their normal operating potentials in order to subject electrodes of the electron gun to a conditioning treatment using intense electric field discharge for the purpose of providing voltage withstanding characteristics for them. But, the conductive film 30 as shown in FIG. 3*a* will function to mitigate the intended high electric field when the conditioning treatment is carried out. As a result, the low discharge electrodes 27 are subjected to an insufficient conditioning treatment, thereby leaving dark current sources. In addition, if discharge takes place within the tube during the conditioning treatment or the usual operation, a part of the conductive film 30 will be scattered and deposited on the low potential electrodes 27*a* and 27*b*, thereby resulting in dark current sources. In the present embodiment, since the conductive film 14 is provided after the above-mentioned ordinary conditioning treatment, there is no fear of insufficient conditioning treatment. Even if an electron emission source should be left on the surface or edges of the low potential electrodes 27 after the conditioning treatment, it is possible to mitigate the concentration of an electric field toward the low potential electrodes 27 owing to existence of the conductive film 14.

In FIG. 5, the conductive film 14 is shown to surround the second grid electrode 27*b*, the first grid electrode 27*a* and the cathode K. It is essential that the conductive film 14 should cover the whole or a part of an area surrounding at least the second grid electrode 27*b* of the electron gun assembly.

According to the present invention including embodiments described later, it is important that a conductive member such as the conductive film 14 should not extend to an area surrounding the focusing electrode 28 or the high potential electrode 29. If the conductive film 14 shown in FIG. 5 is provided over the entire outer surface of the neck section 11 surrounding the electron gun as illustrated in FIG. 4, a high voltage is applied between the focusing electrode 28 or the high-potential electrode 29 and the inner wall of the neck section surrounding them, resulting in discharge therein.

In the above-described embodiment, a metal plate has been used as the conductive film 14. However, the conductive film may be formed by applying a conductive paint mainly composed of Ag, Cu, graphite or the like.

If a transparent conductive film mainly composed of $In_2O_3$, $SnO_2$ or the like is used, the inside of the neck section is visible. The conductive film 14 may also be formed by vapour deposition.

FIG. 6 shows another embodiment of the present invention. This embodiment is different from the FIG. 5 embodiment in that instead of the conductive film 14 a metal wire 15 (stainless steel wire, Cu wire or the like with 0.3 to 1.0 mmϕ) with one or more turns is wound around and in close contact with the neck section 11. If the metal wire 15 is prepared with an inner diameter smaller than the outer diameter of the neck section 11, it can be detachably disposed on the neck section. The metal wire 15 is applied with the same potential as the electrode 27*b* via a lead 60 or the earth potential via a lead 61.

FIG. 7 shows still another embodiment of the present invention wherein a conductive film 14' is provided on the inner surface of the neck section 11. The conductive film 14' is applied with the same potential as the electrode 27*b* via a lead 50' having a contact finger or the earth potential via a lead 51' having a contact finger.

FIG. 8 shows a further embodiment of the present invention wherein a conductive film 14'' is provided on the outer surface of bead glass 26. The conductive film 14'' is applied with the same potential as the electrode 27*b* via a lead 50'' or the earth potential via a lead 51''.

As modifications, a metal wire like the metal wire 15 shown in FIG. 6 may be used instead of the conductive film 14' shown in FIG. 7 and the conductive film 14'' shown in FIG. 8.

Since the conductive film 14' or 14'' is provided inside the neck section in the FIG. 7 or 8 embodiment, there is a fear that the conductive film affects the conditioning treatment for electrodes, especially, low potential electrodes 27. Even if the resulting undesired electron emission sources are left, however, the conductive film 14' or 14'' is effective in suppressing undesired electron emission from those sources during operation of the tube.

The FIG. 5 or 6 embodiment, the FIG. 7 embodiment or its modification, and the FIG. 8 embodiment or its modification can be employed in any combination of two or all thereof.

In the foregoing embodiments, there has been disclosed the electron gun of so-called bi-potential focus type wherein beam focusing is effected by the third and fourth grid electrodes. However, the present invention can be applied to cathode-ray tubes having electron guns of various well known types including a uni-potential focus type wherein beam focusing effected by the third to fifth grid electrodes, a bi-uni-potential focus type wherein beam focusing is effected by the third to sixth grid electrodes, a uni-uni-potential focus type wherein beam focusing is effected by the third to seventh grid electrodes, and a tri-potential focus type wherein beam focusing is effected by the third to sixth grid electrodes. According to the present invention, whichever type of electron gun may be adopted, a conductive member is provided to at least partially cover in a contacting fashion an outer surface portion of the insulative neck section, an inner surface portion of the neck section, and/or an outer surface portion of the insulative supporting bar which surround a portion of the electron gun including a crossover point forming and beam accelerating grid electrode means but excepting a beam focusing grid electrode means.

A cathode-ray tube used for color or black and white television has heretofore described. However, the present invention is applicable to any cathode-ray tube having an electron-gun mount assembly which include an electron beam emitting cathode electrode means, a crossover point forming and beam accelerating grid electrode means, and a beam focusing grid electrode means in this order. Such a cathode-ray tube may include a cathode-ray tube used in an industrial television, a cathode-ray tube used as a display in physical or chemical applications or a computer, and a projection type cathode-ray tube. Thus, the present invention is of great practical value in improving various cathode-ray tubes.

What is claimed is:

1. A cathode-ray tube comprising:

a hermetically sealed, evacuated envelope having an electrically insulative neck section;

an electron-gun mount assembly incorporated into said neck section and including a cathode electrode means for emitting an electron beam, first grid electrode means for forming a crossover point and for accelerating the electron beam, and second grid electrode means for focusing the electron beam, said cathode electrode means, said first grid electrode means and said second grid electrode means being arranged in this order along the tube axis and being mounted on a supporting means having a plurality of electrically insulative supporting bars disposed around said electron-gun mount assembly;

a conductive member which at least partially covers in a contacting fashion at least one of an outer surface portion of said neck section, an inner surface portion of said neck section and an outer surface portion of said supporting means which surround a portion of said electron-gun mount assembly including said first grid electrode means but excepting said second grid electrode means; and a means for applying a predetermined potential to said conductive member during a normal operation of the tube.

2. A cathode-ray tube according to claim 1, wherein said first grid electrode means includes a first grid electrode for forming the crossover point and a second grid electrode means for accelerating the emitted electron beam, and said predetermined potential applied to said conductive member is equal to that applied to said second grid electrode.

3. A cathode-ray tube according to claim 1, wherein said predetermined potential applied to said conductive member is the earth potential.

4. A cathode-ray tube according to claim 1, wherein said conductive member is a film made of a conductive material.

5. A cathode-ray tube according to claim 4, wherein said conductive material film is transparent.

6. A cathode-ray tube according to claim 1, wherein said conductive member is a conductor winding having at least one turn.

7. A cathode-ray tube according to claim 6, wherein said conductor winding is detachably disposed.

* * * * *